US009422793B2

(12) United States Patent
Gomes et al.

(10) Patent No.: US 9,422,793 B2
(45) Date of Patent: Aug. 23, 2016

(54) EROSION TRACER AND MONITORING SYSTEM AND METHODOLOGY

(75) Inventors: Luiz Gomes, Rio de Janeiro (BR); Stephen D. Mason, Katy, TX (US); Francois M. Auzerais, Boston, MA (US); Robert Krush, Sugar Land, TX (US); Mehmet Parlar, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 864 days.

(21) Appl. No.: 13/274,849

(22) Filed: Oct. 17, 2011

(65) Prior Publication Data

US 2012/0118564 A1 May 17, 2012

Related U.S. Application Data

(60) Provisional application No. 61/394,590, filed on Oct. 19, 2010.

(51) Int. Cl.

| | |
|---|---|
| ***E21B 47/11*** | (2012.01) |
| ***E21B 43/08*** | (2006.01) |
| ***E21B 47/01*** | (2012.01) |
| ***E21B 47/10*** | (2012.01) |
| ***E21B 47/12*** | (2012.01) |

(52) U.S. Cl.

CPC ..... *E21B 43/08* (2013.01); *E21B 47/011* (2013.01); *E21B 47/1015* (2013.01); *E21B 47/124* (2013.01)

(58) Field of Classification Search

CPC . E21B 47/044; E21B 44/005; E21B 47/1015; E21B 12/02

USPC ..... 166/250.12, 250.05, 53; 175/39

See application file for complete search history.

(56) References Cited

U.S. PATENT DOCUMENTS

| | | | |
|---|---|---|---|
| 3,818,227 | A | 6/1974 | Fries |
| 3,991,827 | A | 11/1976 | Schall |
| 4,008,763 | A | 2/1977 | Lowe, Jr. |

(Continued)

FOREIGN PATENT DOCUMENTS

| | | | |
|---|---|---|---|
| EP | 1301686 | B1 | 4/2005 |
| EP | 1277051 | B1 | 8/2006 |

(Continued)

OTHER PUBLICATIONS

Hyne, Norman. Nontechnical Guide to Petroleum Geology, Exploration, Drilling, and Production 2$^{nd}$ , 2001, PennWell Corporation 343-344.*

(Continued)

*Primary Examiner* — Jennifer H Gay

*Assistant Examiner* — David Carroll

(74) *Attorney, Agent, or Firm* — Jeffery R. Peterson

(57) ABSTRACT

A technique provides a system and methodology for detecting and monitoring erosion in various environments, including downhole environments. A tracer element is located in a component such that sufficient erosion of the component due to fluid flow exposes the tracer element. A monitoring system is disposed for cooperation with the tracer element such that exposure of the tracer element is detected by the monitoring system. The monitoring system outputs appropriate data indicative of the erosion to enable adjustments to the fluid flow.

20 Claims, 3 Drawing Sheets

(56) References Cited

U.S. PATENT DOCUMENTS

| | | | | |
|---|---|---|---|---|
| 5,892,147 | A | 4/1999 | Games et al. | |
| 5,929,437 | A | 7/1999 | Elliott et al. | |
| 6,023,340 | A | 2/2000 | Wu et al. | |
| 6,075,611 | A | 6/2000 | Dussan et al. | |
| 6,349,766 | B1 | 2/2002 | Bussear et al. | |
| 6,645,769 | B2 * | 11/2003 | Tayebi et al. | 436/56 |
| 6,672,385 | B2 * | 1/2004 | Kilaas et al. | 166/250.01 |
| 6,840,316 | B2 | 1/2005 | Stegemeier et al. | |
| 6,891,477 | B2 | 5/2005 | Aronstam | |
| 6,993,432 | B2 | 1/2006 | Jenkins et al. | |
| 7,464,771 | B2 * | 12/2008 | Lynde | 175/42 |
| 7,473,672 | B2 | 1/2009 | Kotlar et al. | |
| 7,560,690 | B2 | 7/2009 | Stray et al. | |
| 7,635,033 | B2 * | 12/2009 | Lynde | 175/42 |
| 7,711,486 | B2 | 5/2010 | Thigpen et al. | |
| 8,230,731 | B2 | 7/2012 | Dyer et al. | |
| 8,567,497 | B2 * | 10/2013 | Moen et al. | 166/252.6 |
| 2001/0036667 | A1 | 11/2001 | Tayebi et al. | |
| 2002/0020527 | A1 | 2/2002 | Kilaas et al. | |
| 2003/0056952 | A1 | 3/2003 | Stegemeier et al. | |
| 2004/0168811 | A1 | 9/2004 | Means et al. | |
| 2004/0204856 | A1 * | 10/2004 | Jenkins et al. | 702/6 |
| 2007/0241277 | A1 | 10/2007 | Stray et al. | |
| 2007/0289740 | A1 | 12/2007 | Thigpen et al. | |
| 2008/0000690 | A1 * | 1/2008 | Lynde | 175/42 |
| 2008/0210421 | A1 | 9/2008 | Wilson et al. | |
| 2008/0262735 | A1 | 10/2008 | Thigpen et al. | |
| 2008/0262737 | A1 | 10/2008 | Thigpen et al. | |
| 2009/0133874 | A1 | 5/2009 | Dale et al. | |
| 2010/0307745 | A1 * | 12/2010 | Lafitte et al. | 166/250.12 |
| 2011/0024111 | A1 * | 2/2011 | Moen et al. | 166/278 |
| 2011/0239754 | A1 | 10/2011 | Dyer et al. | |
| 2011/0257887 | A1 * | 10/2011 | Cooper et al. | 702/12 |
| 2012/0118564 | A1 | 5/2012 | Gomes et al. | |
| 2013/0017610 | A1 * | 1/2013 | Roberts et al. | 436/27 |
| 2013/0062063 | A1 * | 3/2013 | Baihly et al. | 166/297 |

FOREIGN PATENT DOCUMENTS

| | | | |
|---|---|---|---|
| EP | 1355038 | B1 | 11/2006 |
| EP | 1774137 | B1 | 2/2008 |
| RU | 2390629 | C2 | 5/2010 |
| WO | 0181914 | A1 | 11/2001 |
| WO | 2007102023 | A1 | 9/2007 |
| WO | 2009009196 | | 1/2009 |
| WO | 2009009196 | A2 | 1/2009 |
| WO | 2012054496 | | 4/2012 |
| WO | 2012054496 | A2 | 4/2012 |

OTHER PUBLICATIONS

International Search Report and Written Opinion issued in PCT/US2011/056730 on May 18, 2012, 11 pages.

S. Tosic, et al. "New Flux Surveillance Approach for High Rate Wells", SPE 115689 (2008), 19 pages.

Presentation—SPE 115689—New Flux Surveillance Approach for High Rate Wells, 24 pages by Slavko Tosic, Noble Energy Inc; Christine Ehlig-Economides, Texas A&M; Michael J. Economides, University of Houston; Mike C. Vincent, Insight Consulting.

International Search Report and Written Opinion issued in PCT/US2011/027251 on Aug. 26, 2011, 10 pages.

AU 2011317198, Examination Report dated Oct. 16, 2014, 3 pgs.

CA 2,814,494, Examination Report and Search Report dated Nov. 7, 2014, 5 pgs.

RU 2013122856, Official Action dated Jul. 7, 2014, 4 pgs.

RU 2013122856, Decision of Grant dated May 8, 2015, 6 pgs.

RU 2013122856, Official Action dated Nov. 27, 2014, 6 pgs.

CA 2,814,494, Examination and Search Report, Sep. 1, 2015, 4 pages.

Konstantinov, I O. et al., "Radiometricheskii monitoring korrosii promislovih nefteprovodov", (Radiometric Monitoring of Corrosion of Oilfield Pipelines) Zaschita metallov, vol. 32, No. 1, 1996.

* cited by examiner

EROSION TRACER AND MONITORING SYSTEM AND METHODOLOGY

CROSS-REFERENCE TO RELATED APPLICATION

The present document is based on and claims priority to U.S. Provisional Application Ser. No. 61/394,590, filed Oct. 19, 2010, incorporated herein by reference.

BACKGROUND

In a variety of well applications, particulates in fluid flows can cause erosion of downhole components, such as erosion of sand screens and other completion hardware. The potential for erosion is a factor in determining proper control over fluid flow parameters. When bringing on production of a sand prone hydrocarbon producing well, for example, various determinations are made with respect to the speed at which production can be ramped up without breaching the filter media. Determinations also are made with respect to the optimum flow rate of production fluids to avoid causing erosion to the filter media or to other completion hardware. However, determining desirable flow rates can be difficult and the optimum or otherwise desired flow rate can change over time.

SUMMARY

In general, the present disclosure provides a system and methodology for detecting and monitoring erosion in, for example, a downhole environment. A tracer element is located in a component such that sufficient erosion of the component due to fluid flow exposes the tracer element. A monitoring system is disposed for cooperation with the tracer element such that exposure of the tracer element is detected by the monitoring system. The monitoring system outputs appropriate data indicative of the erosion to enable adjustments to the fluid flow.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

Figure 1:
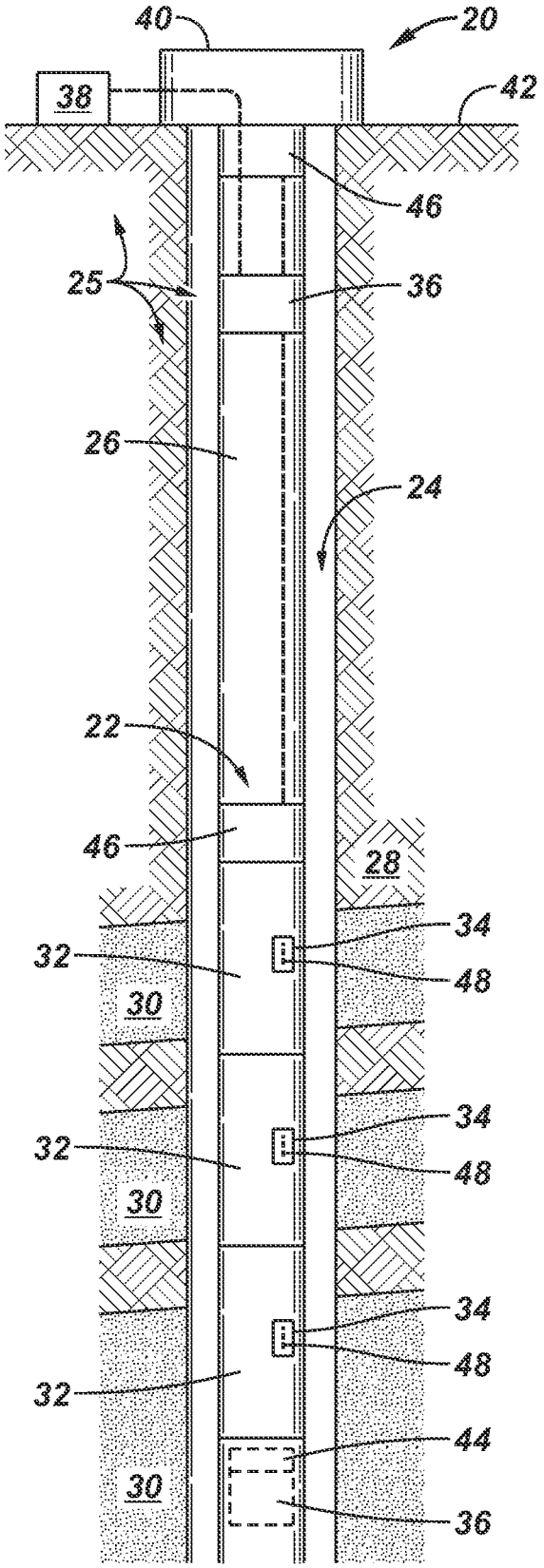
FIG. 1 is a schematic illustration of an example of a well system comprising a component having a tracer element, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate detection of erosion due to flowing fluids, e.g. detection of well component erosion due to flowing fluids in a well. According to an embodiment of the disclosure, a tracer element is employed in an erosion tracer and monitoring system to detect erosion at discrete and/or relative well interval locations, e.g. production well interval locations. The system and methodology also may be employed to monitor the erosion and to provide feedback to prevent further material loss. If a predetermined degree of erosion occurs, the well production can be adjusted to a lower rate; the well may be shut off at discrete intervals of production; the well production can be deferred to a later date after manual intervention of the wellbore; and/or the amount and rate of erosion may be continually tracked over time.

In injection well applications, the system and methodology also may be employed to detect and monitor erosion. Depending on the type of tracer element employed, an erosion monitor may be located downstream from a tracer element and telemetry methods may be employed to transmit erosion data from the erosion monitor to a surface location. Upon detection of a predetermined degree of erosion occurring at a discreet or relative injection interval in a filter media or other component, the injection rate can be reduced or otherwise adjusted. In some applications, the well may be shut in and subjected to intervention operations with corresponding well treatments. The detection of erosion also may lead to injection profile modification such that the injection well is operated within allowable operating erosion conditions. The data provided by the erosion monitoring system also can be used to increase the injection rate (or production rate) to a safe threshold of acceptable erosion during operation of the injection or production well.

By way of example, an embodiment of the disclosure comprises an erosion tracer and monitoring system designed to determine where and when sand screen erosion occurs downhole. An embodiment of the erosion/tracer element may be a commercially viable continuous length of metal with embedded tracer such that the tracer is activated when sufficient erosion of the material, e.g. metal, occurs on the face of the sand screen or other completion component located within the wellbore. The tracer element or elements can be located at a single discreet location or throughout a completion interval, e.g. along a sand screen interval, to create a vigilant system for monitoring localized erosion and/or to create a passive system for monitoring general erosion along a well interval.

In some well applications, monitoring of erosion may take place at a wellhead in a manner which enables the well to be opened for increased fluid flow at a desired, e.g. optimized, production rate or injection rate. Depending on the data obtained and output by the monitoring system, the well also may be choked back or shut in to determine an appropriate intervention prior to incurring damage to filter media or other completion hardware. The data obtained from the erosion monitoring system also can be used to selectively and/or automatically operate the well at a steady state without erosion or with controlled erosion while continually monitoring future erosion of the completion component. If the well application is a subsea application, the erosion monitor may be located at, for example, the seafloor. The feedback and control capabilities of the monitoring system also may be used for local flow rate adjustment; and/or erosion data may be transmitted to a remote location for further evaluation.

Various embodiments of the disclosure comprise a system and methodology for detecting erosion along a producing interval or an injecting interval of a well with discrete or relative location/position identification. The system and methodology also enable monitoring of erosion at the location while providing feedback regarding the specific erosion or lack of erosion. The feedback may be provided to a desired location, such as a surface location, and/or used to automatically change the rate of fluid flow by adjusting a flow control device. In some applications, an erosion monitor may be located downhole and the erosion data may be transmitted uphole to a surface display device and/or used for automatically controlling, e.g. optimizing, the fluid flow rate of the production or injection well. In some applications, well production or injection may be adjusted such that erosion of completion components is within an allowable erosion operating window. The fluid flow rate also may be reduced to defer material loss, e.g. metal loss, with respect to filter media or other completion components. The system and methodology also may be employed to detect high velocity flow areas in production or injection intervals. Many types of tracer elements may be used to indicate erosion of components, including erosion tag elements which are released and carried by the fluid flow to an erosion monitor able to detect the material as indicative of erosion.

Referring generally to FIG. 1, an example of one type of application utilizing a plurality of downhole completion components and corresponding tracer elements is illustrated. The example is provided to facilitate explanation and it should be understood that a variety of well completion systems and other well or non-well related systems may utilize the methodology described herein. The downhole completion components and corresponding tracer elements may be located at a variety of positions and in varying numbers along the well completion or other tubular structure.

In FIG. 1, an embodiment of a well system 20 is illustrated as comprising a downhole well completion 22 deployed in a wellbore 24 and monitored by an erosion monitoring and control system 25. The well completion 22 may be part of a tubing string or tubular structure 26, such as production tubing or well casing, although the tubular structure 26 also may comprise many other types of well strings, tubing and/or tubular devices. Additionally, the well completion 22 may include a variety of components, depending in part on the specific application, geological characteristics, and well type. For example, the well completion 22 may comprise filter media in the form of a sand screen or sand screens as well as a variety of other completion components.

In the example of FIG. 1, the wellbore 24 is illustrated as generally vertical with the downhole well completion 22 deployed along the generally vertical wellbore. However, various well completions 22 and other embodiments of downhole equipment may be used in the well system 20 and may be deployed in other types of wellbores, including deviated, e.g. horizontal, single bore, multilateral, cased, and uncased (open bore) wellbores.

In the example illustrated, wellbore 24 extends down through a subterranean formation 28 having at least one and often a plurality of well zones 30. The well completion 22 comprises a plurality of components 32, such as sand screens. However, components 32 may comprise additional and/or alternate types of well tools and components. By way of example, the well components 32 may be associated with tracer elements 34 of the erosion monitoring and control system 25. The tracer elements 34 are designed to provide an indication of erosion upon the occurrence of a sufficient amount of erosion with respect to a corresponding well component 32. In some applications, a single tracer element 34 may be deployed to provide an indication of erosion at a specific discrete location or to provide an indication of general erosion along a well interval, e.g. along an extended component such as a sand screen. In other applications, a plurality of tracer elements 34, as illustrated, may be employed to detect erosion at a plurality of corresponding components 32 or at a plurality of locations along a single, elongated component 32. The tracer elements 34 also may be designed to provide a unique indicator relative to the other tracer elements to enable monitoring of erosion at specific components and/or at specific locations along the wellbore 24.

The tracer elements 34 cooperate with an erosion monitor 36 designed to monitor the individual tracer element or plurality of tracer elements 34. For example, the erosion monitor 36 may be designed to detect material released from the tracer element 34 upon sufficient erosion of well component material to expose the tracer element 34. In other embodiments, exposure of the tracer element 34 to flowing well fluid causes the tracer element to provide another type of signal, e.g. electrical, which is detected by the erosion monitor 36. Regardless of the specific type of tracer element 34, data from the tracer element is relayed to the erosion monitor 36 which may be part of a control system 38 or which may transmit the data to control system 38.

Depending on the type of well operation, the erosion monitor 36 may be positioned at a variety of locations. For example, the erosion monitor 36 may be located in or near a wellhead 40 located at a surface 42, such as an earth surface or a seabed. In some injection applications, the erosion monitor 36 may be located downhole at a location downstream from the tracer elements 34. (See dashed lines in FIG. 1). When the erosion monitor 36 is located downhole, a suitable telemetry system 44, e.g. a wired or wireless telemetry system, may be employed to relay data uphole to control system 38 at, for example, surface location 42. The telemetry system 44 may be designed to operate independently or it may be combined with telemetry systems used to convey data regarding other well parameters, such as pressure, temperature and flow rate.

Based on the data provided by erosion monitor 36, the production/injection fluid flow rate may be maintained or adjusted to optimize or otherwise change the flow rate. For example, the flow rate may be reduced to slow or prevent erosion, or the flow rate may be increased to enhance production or injection while maintaining the rate of erosion within a desirable operating window. In some applications, the data from erosion monitor 36 is relayed to control system 38 which is used to display and/or to automatically control the fluid flow rate. For example, the control system 38 may be used to automatically adjust a flow control device 46 or a plurality of flow control devices 46. The flow control device 46 may be located at the wellhead 40 in some operations, however other operations benefit from one or more flow control devices 46 positioned at desired downhole locations. Additionally, control system 38 may be combined with the erosion monitor or monitors 36 at a surface location or add a downhole location to automatically control the flow control devices 46 according to the degree of erosion or lack of erosion indicated by tracer elements 34.

The erosion/tracer element 34 may have a variety of forms and may be positioned in a variety of locations. For example, the tracer element 34 may be embedded in individual well components 32 such that erosion of the well component 32 to a sufficient degree exposes the tracer element 34 and signals erosion monitor 36. In some applications, the tracer element 34 may comprise a sacrificial element, such as a continuous length of wire, rod or other element of suitable geometry. The sacrificial element may have a similar metallurgy and yield strength compared to the well component, e.g. screen filter media or completion component. Exposure of the tracer element 34 during erosion releases tracer element material which is flowed in the fluid stream and detected by the erosion monitor 36 at the wellhead 40 or at another suitable location. With multiple tracer elements 34, each tracer element 34 may have a unique identification or signature corresponding to the specific well component and/or interval position to provide an indication as to the specific location incurring erosion. The tracer element 34 and erosion monitor 36 also may be designed to determine the rate of erosion, e.g. the rate of metal loss of the well component 32. For example, the erosion monitor system 36 may be designed to monitor the amount of tracer element 34 released into the fluid stream due to the erosion to determine the extent of the erosion. It should be noted that the tracer elements 34 may comprise a variety of materials and configurations, including electrical elements, light/optical elements, sensors, and various other elements able to provide an indication of the erosion.

The location of erosion/tracer element 34 with respect to the well component 32 can vary depending on the design and parameters of the monitoring system. For example, tracer elements 34 may be located within, on, and/or between sand screen filter media features. With wire wrapped filter media, for example, the tracer elements 34 may be located in the filter media, in the inner drainage layer, in the base pipe, and/or in various combinations of these features. Similarly, with wire mesh filter media, the tracer elements 34 may be located in the shroud, in the outer drainage layer, in the filter media, in the inner drainage layer, in the base pipe, and/or in various combinations of these features. With other types of filter media, the tracer elements may be located within individual features or various combinations of features, including shrouds, filter media, and base pipes. Alternate path type sand screens may convey the tracer element on or within the outer shroud or on or within the alternate path transport or packing tubes. In some downhole completions, the tracer element 34 may be conveyed on/within hydraulic lines, electrical lines, or other control cables or conduits. The tracer element 34 also may be conveyed on/within casing, production tubing, blast joints, perforated pipe, production liners, or other completion equipment.

Tracer elements 34 may comprise many types of elements embedded in the material subject to erosion. For example, the tracer elements 34 may comprise tracer tags 48 formed of unique combinations of natural or man-made elements embedded in the sacrificial erosion element or incorporated within completion components. The tracer tags 48 are formed of material released due to erosion and are generally different from naturally occurring elements found in the reservoir, wellbore, completion components, well treatment fluids, or produced/injected fluids. Examples of sources of unique tracer tags 48 comprise unique elements that may be embedded to provide identification of wellbore depth and/or interval position upon sufficient erosion. The tracer tags 48 may comprise various radioactive isotopes, chemicals, or other materials that can be carried in the fluid flow to the erosion monitor 36. The tracer tags 48 also may comprise material particles with specific characteristics, including characteristics related to: light refraction, geometric shape, mass, physical size, unique embedded codes, electrical resistance, length-width-height-diameter-circumference-perimeter-surface area-volume characteristics, mathematical combinations of these characteristics, e.g. specific ratios, surface roughness, pressure or light pulses, and/or unique color characteristics. Other methods for detecting the release of unique tracer tags 48 include the use of scientific methods for differentiation related to human-type senses, such as sight, smell, touch (feel), hearing (acoustic waves), taste, or various combinations thereof.

However, the tracer elements 34 may comprise a variety of other types of erosion indicators. For example, the tracer elements 34 may comprise sensor materials which output an appropriate signal, such as a radio, electrical, light, acoustic, pressure and/or sonic signal through an appropriate telemetry system 44 to erosion monitor 36. By way of example, the tracer element 34 may comprise an electrical element that undergoes a characteristic change, e.g. a change in resistance, when exposed to a flowing fluid in the well. This change can then be relayed to the erosion monitor 36 as indicative of eroding material at the specific well component 32. Regardless of the type of tracer elements 34 employed, position identifications may be made at discrete locations or relative to another position. Additionally, the system 25 may be employed for erosion monitoring and control regardless of wellbore orientation, deviation, completion type, or form of hydrocarbon production or fluid ejection. The erosion monitoring and control system 25 also may comprise many types of components, e.g. tracer elements 34, erosion monitor 36, control system 38, flow control devices 46, and other components as desired for a specific application.

Figure 2:
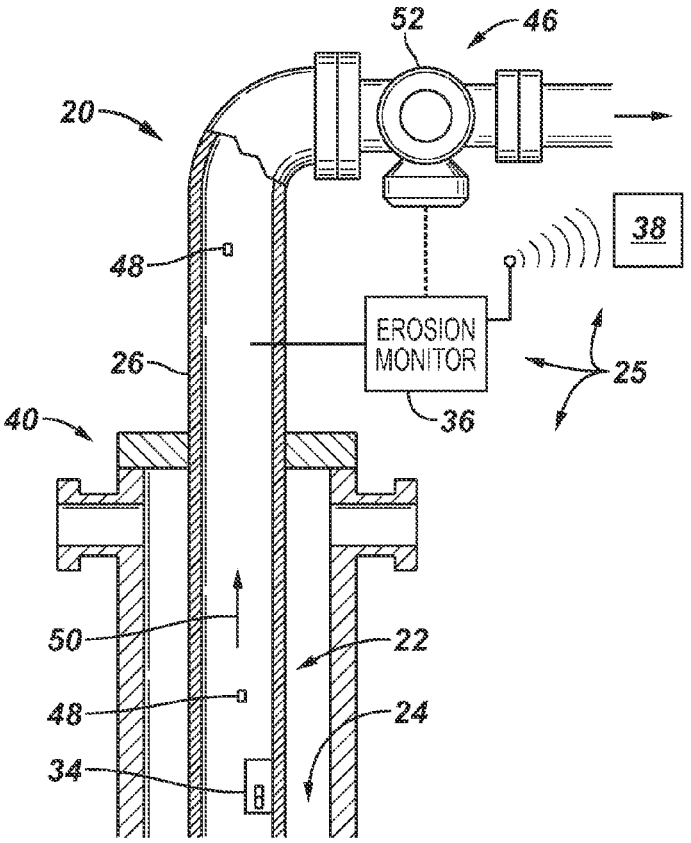
FIG. 2 is a schematic illustration of a production well system comprising a tracer element, according to an embodiment of the disclosure.

Referring generally to FIG. 2, an embodiment of system 20 is illustrated as comprising a production system in which well fluid is produced up through tubing 26. In this embodiment, sufficient erosion of the well screen or other completion component 32 releases tracer tags 48 which flow upwardly with the well fluid as indicated by arrow 50 for detection and monitoring by erosion monitor 36. The erosion monitor 36 is designed to output data regarding erosion and erosion location (based on the unique characteristics of the tracer tags 48) to control system 38. The control system 38 may be used to process and display erosion data and/or to automatically control one or more flow control devices 46. In the example illustrated, flow control device 46 is automatically controlled and comprises a choke 52 positioned along tubing 26 at a surface location 42.

Figure 3:
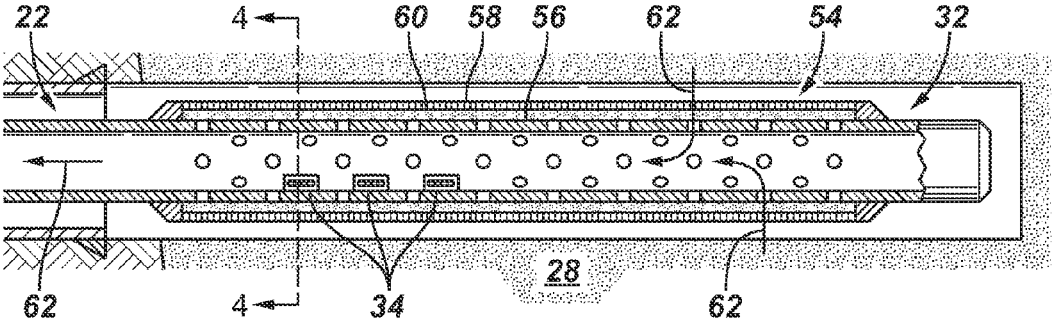
FIG. 3 is a schematic illustration of a well component in the form of a sand screen incorporating a tracer element, according to an embodiment of the disclosure.
Figure 4:
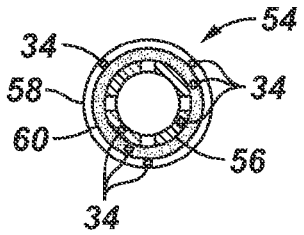
FIG. 4 is a cross-sectional view taken generally along line 4-4 of FIG. 3, according to an embodiment of the disclosure.

By way of example, the well component 32 may comprise a sand screen component 54, as illustrated in FIGS. 3 and 4. In this example, sand screen 54 comprises a base pipe 56, a shroud 58, and a filter media 60 disposed between the base pipe 56 and the shroud 58. Production fluid flows from the surrounding formation 28, into sand screen 54, and along an interior of the sand screen 54, as indicated by arrows 62. The inflowing well fluid often contains particulates which can erode components of the sand screen, such as the base pipe 56, filter media 60, and/or shroud 58. Accordingly, tracer elements 34 may be positioned on or within the base pipe 56, the filter media 60, and/or the shroud 58, as best illustrated in FIG. 4. In some embodiments, the tracer elements 34 are embedded within the material used to form the sand screen components, such that erosion of the material releases tracer tags 48 for detection by erosion monitor 36.

Figure 5:
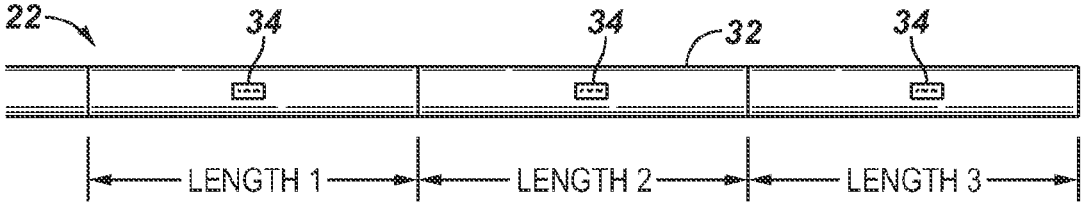
FIG. 5 is a schematic illustration of a component or a plurality of components having a plurality of tracer elements, according to an embodiment of the disclosure.

With relatively long well components 32, such as sand screens 54 extending over substantial regions of formation 28, the tracer elements 34 may be positioned at various sections along the elongate component 32, as illustrated in FIG. 5. Each tracer element 34 may be designed to release unique tracer tags 48 upon sufficient erosion to provide an indication with respect to the specific location or the general interval of the well component 32 incurring the detrimental erosion. The released tracer tags 48 are detected and monitored by erosion monitor 36 to enable adjustment, if necessary, to the flow rate. In some applications, a plurality of flow control devices 46 may be independently adjusted based on the erosion data obtained by erosion monitor 36 to control the flow rate from or to specific well zones 30.

Figure 6:
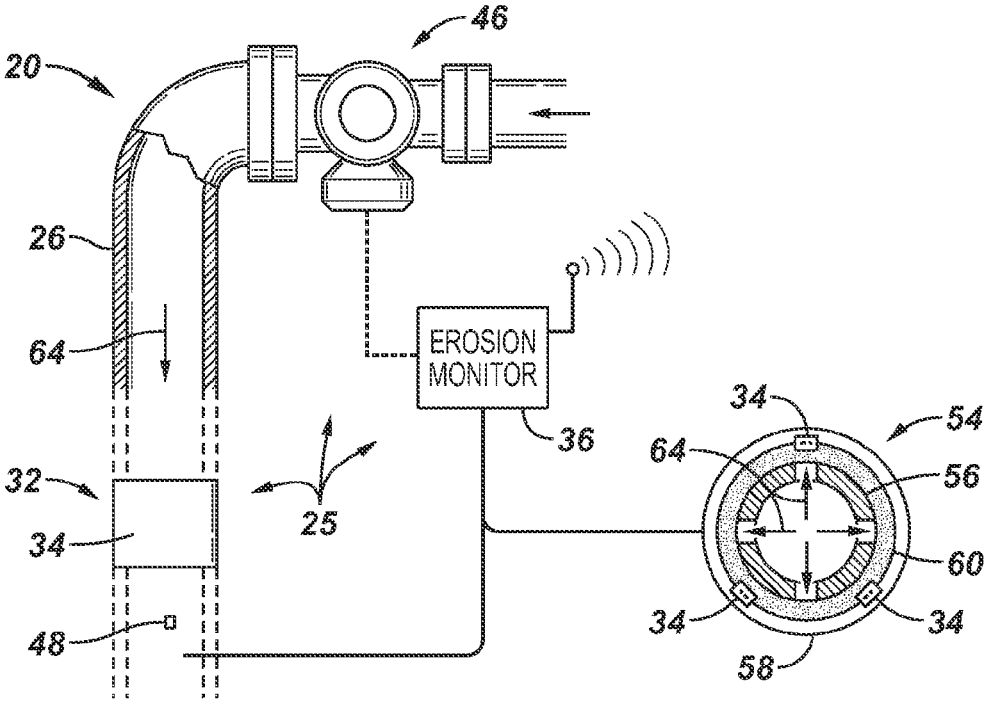
FIG. 6 is a schematic illustration of an injection well system comprising a tracer element, according to an embodiment of the disclosure.

As described above, the erosion monitoring and control system 25 also may be used for injection well applications, as illustrated schematically in FIG. 6. In this embodiment, sufficient erosion of the sand screen or other injection well component 32 releases tracer tags 48 which flow downwardly with the injection fluid as indicated by arrow 64 for detection and monitoring by erosion monitor 36. The erosion monitor 36 is again designed to output data regarding erosion and erosion location (based on the unique characteristics of the tracer tags 48) to control system 38. The control system 38 may be used to process and display erosion data and/or to automatically control one or more flow control devices 46. In the example illustrated, flow control device 46 is automatically controlled and is positioned along tubing 26 at a surface location 42 to increase or decrease the rate of injection fluid flow based on the erosion data obtained and transmitted by erosion monitor 36.

The system and methodology for monitoring and controlling erosion may be employed in non-well related applications which are potentially subjected to erosive fluid flow along a tubular structure. Similarly, the system and methodology may be employed in many types of well applications, including a variety of production and injection applications. The tracer elements may be positioned in many types of sand screens and sand screen components as well as in a variety of other completion components to provide erosion data at discrete locations or along substantial well intervals. The tracer elements also may comprise many types of tracer materials attached to and/or embedded in materials used to form various well components. The number and arrangement of tracer elements positioned along the tubular structure also can vary substantially from one type of application to another. Additionally, the design of erosion monitoring system 36 can vary depending on the type tracer element 34/tracer material 48 being monitored.

The feedback provided by the tracer elements and erosion monitor may be used to optimize or otherwise adjust production or injection fluid flows to improve results. Depending on the feedback obtained via data supplied by the tracer elements and erosion monitor, the control system may be operated to adjust or the control system may be programmed to automatically adjust flow rates through the entire well or along specific zones within the well. For example, the feedback may be used to maintain operation of the well at a steady state, to increase the flow rate, to decrease the flow rate, or to shut off the fluid flow. In some applications, the fluid flow may be shut off temporarily to enable modification of the production/injection profile, to enable well interventions, and/or to isolate a portion or portions of the production/injection interval.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for detecting erosion downhole, comprising:

locating a tracer element within a material of a well component by embedding the tracer element within the well component so that sufficient erosion of the material initiates continued release of the tracer element;

providing a monitoring system to monitor exposure of the tracer element and thus erosion of the well component by a flowing fluid;

using the monitoring system to output data related to erosion of the well component; and adjusting a flow rate in a well based on the output data from the monitoring system.

2. The method as recited in claim 1, wherein using comprises using the monitoring system to monitor erosion of the well component in a production well.

3. The method as recited in claim 1, wherein using comprises using the monitoring system to monitor erosion of the well component in an injection well.

4. The method as recited in claim 1, wherein providing comprises providing the monitoring system to monitor erosion at a discreet location.

5. The method as recited in claim 1, wherein providing comprises providing the monitoring system to monitor erosion within a well interval.

6. The method as recited in claim 1, further comprising automatically controlling a flow control device based on the output data from the monitoring system.

7. The method as recited in claim 1, wherein locating comprises locating the tracer element within a downhole filter media.

8. The method as recited in claim 1, wherein locating comprises locating the tracer element within a base pipe.

9. The method as recited in claim 1, wherein locating comprises locating the tracer element within a shroud.

10. The method as recited in claim 1, wherein locating comprises locating a radioactive tracer element within the material.

11. The method as recited in claim 1, wherein locating comprises locating a chemical tracer element within the material.

12. The method as recited in claim 1, wherein locating comprises locating an electrical tracer element within the material.

13. The method as recited in claim 1, wherein locating comprises locating a plurality of unique position tag tracer elements within the material.

14. A method for monitoring erosion in a well component, comprising:

embedding a tracer element in a completion component located in a wellbore in a manner which indicates a rate of erosion of the completion component;

flowing fluid past the completion component during a downhole operation;

monitoring the amount of the tracer element in the flowing fluid due to erosion of the completion component by the flowing fluid;

determining the rate of the erosion based on the amount of tracer element in the flowing fluid; and using a flow control device to change the flow rate of the fluid, if necessary, based on monitoring of the completion component.

15. The method as recited in claim 14, wherein embedding comprises embedding the tracer element in a sand filter media.

16. The method as recited in claim 14, wherein flowing the fluid comprises flowing a production fluid.

17. The method as recited in claim 14, wherein flowing the fluid comprises flowing an injection fluid.

18. A system for monitoring erosion, comprising:

a well component subject to erosive fluid flow in a wellbore;

a tracer element in the form of a sacrificial element embedded in the well component, the tracer element being exposed upon sufficient erosion of the well component due to fluid flow in the wellbore;

a monitoring system to detect the amount of the tracer element in the flowing fluid; and a flow control device cooperating with the monitoring system to adjust flow based on data output by the monitoring system.

19. The system as recited in claim 18, wherein the well component is part of a downhole completion and the fluid flow is a production fluid flow.

20. The system as recited in claim 18, wherein the well component is part of a downhole completion and the fluid flow is an injection fluid flow.

* * * * *